United States Patent [19]

Sassak

[11] Patent Number: 4,528,740

[45] Date of Patent: Jul. 16, 1985

[54] SHRINK RING CLAMP ASSEMBLY

[75] Inventor: Frank Sassak, Grand Rapids, Mich.

[73] Assignee: MSW Corporation, Grand Rapids, Mich.

[21] Appl. No.: 485,866

[22] Filed: Apr. 18, 1983

[51] Int. Cl.[3] ..... B21D 39/00

[52] U.S. Cl. ..... 29/516; 29/283.5; 72/416; 285/382.2

[58] Field of Search ..... 72/416, 415, 418; 29/447, 283.5, 516, 237; 285/382.2, 382.7; 76/107 R

[56] References Cited

U.S. PATENT DOCUMENTS

| | | | |
|---|---|---|---|
| 2,719,345 | 10/1955 | Riker | 285/382.2 |
| 3,057,233 | 10/1962 | Turner | 72/416 |
| 3,068,563 | 12/1962 | Reverman | 29/283.5 |
| 3,769,678 | 11/1973 | Marsden | 72/412 |
| 3,919,877 | 11/1975 | Netta | 72/416 |
| 3,937,050 | 2/1976 | Nicholson | 72/416 |
| 4,292,833 | 10/1981 | Lapp | 72/416 |
| 4,330,924 | 5/1982 | Kushner et al. | 285/382.2 |
| 4,385,514 | 5/1983 | Sassak | 72/416 |
| 4,426,761 | 1/1984 | Sassak | 29/447 |

*Primary Examiner*—Daniel C. Crane
*Assistant Examiner*—David B. Jones
*Attorney, Agent, or Firm*—Cullen, Sloman, Cantor, Grauer, Scott & Rutherford

[57] ABSTRACT

A shrink ring clamp assembly for securing together a pair of telescoped pipes comprises opposed die holders within which are secured opposed coplanar semi-circular shrink ring die segments, so that when the die holders and segments are compressively drawn together relative to a pair of telescoped pipes, concentric annular channels and a bead are formed therein providing an annular mechanical interlock and seal between the pipes. The method of securing the pipes together including the step of forcefully drawing together a pair of coplanar shrink ring die segments relative to a pair of telescoped pipes therebetween to form concentric channels and a bead therebetween providing an annular mechanical interlocking seal throughout 360°.

1 Claim, 8 Drawing Figures

SHRINK RING CLAMP ASSEMBLY

BACKGROUND OF THE INVENTION

Heretofore various types of clamps including U-bolt clamps and the like have been employed for securing together a pair of telescoped pipes. Conventional clamps heretofore have employed one or more fasteners drawing up the clamp and an associated saddle to surround a pair of telescoped pipes for securing them together at their overlap.

There has long existed the problem of providing an effective, inexpensive and simple method by which a pair of telescoped pipes may be secured and sealed together throughout 360°. Such securing of telescoped pipes occurs in the connection between adjacent pipes in a vehicle exhaust system, though not limited thereto.

Related Patent Application

Applicant's copending patent application, Ser. No. 265,901, filed May 21, 1981 now U.S. Pat. No. 4,426,761 dated Jan. 24, 1984, relates to a pipe clamp and method of clamping, Disclosed in the application replacing the use of conventional clamps, there is employed a shrink ring adapted to surround a pair of telescoped pipes together with a power mechanism for peripherally shrinking the ring with respect to the pipes and for forming concentric peripheral channels and a bead within said pipes for an annular mechanical interlock and seal throughout 360°. Said copending application also included the method by which the ring is peripherally shrunk throughout 360° around a pair of telescoped pipes for forming concentric annular channels within said pipes, an annular bead within the outer pipe nested within the channel of the inner pipe providing a mechanical interlock and seal between the pipes and for the securing of the ring upon the assembled pipes.

SUMMARY OF THE INVENTION

An important feature of the present invention is to eliminate the use of the shrink ring disclosed in Applicant's copending application and instead provide a clamp assembly which will accomplish the same results wherein a pair of shrink ring die segments of semi-circular shape are nested within a pair of opposed die supports and mechanical means are employed for drawing the die supports together for forming concentric annular channels and a bead between the pipes providing an annular mechanical interlock and seal therebetween.

A further feature is to eliminate the ring as a fastening means for interconnecting the pipes and to provide semi-circular die segments arranged in opposed relationship within a clamp mechanism whereby the segments are compressively drawn towards each other so as to form in the telescoped pipes interlocking concentric and annular channels within the pipes.

A further feature contemplates after the annular deforming of the telescoped pipes by the shrink ring die segments of the clamp, upon opening of the clamp, the pipes remain interconnected without any other fastening means in view of the substantially permanent deformation of the pipes and the annular concentric channels and bead formed therein.

A further feature is to provide a power means for a shrink ring clamp assembly wherein a pneumatically operated power cylinder and piston rod are mounted as to interconnect the die supports mounting semi-circular die segments so that the power cylinder will bring the die supports forcefully together with respect to a pair of telescoped pipes forming interlocked annular channels therein.

A further feature is to provide an improved shrink ring clamp assembly wherein instead of the shrink ring permanently remaining on the telescoped interconnected telescoped pipes, the ring segments form a part of the clamping die and on separation of the die supports are disengaged from the pipes.

A further feature contemplates the removability of the opposed pair of semi-circular shrink ring die segments so that shrink rings of different interior diameter may be employed to accomodate different size pipe assemblies.

These and other objects and features will be seen from the following Specification and claims in conjunction with the appended drawings.

THE DRAWINGS

It will be understood that the above drawings illustrate merely a preferred embodiment of the invention, and that other embodiments are contemplated within the scope of the claims hereafter set forth.

DETAILED DESCRIPTION OF AN EMBODIMENT OF THE INVENTION

Figure 1:
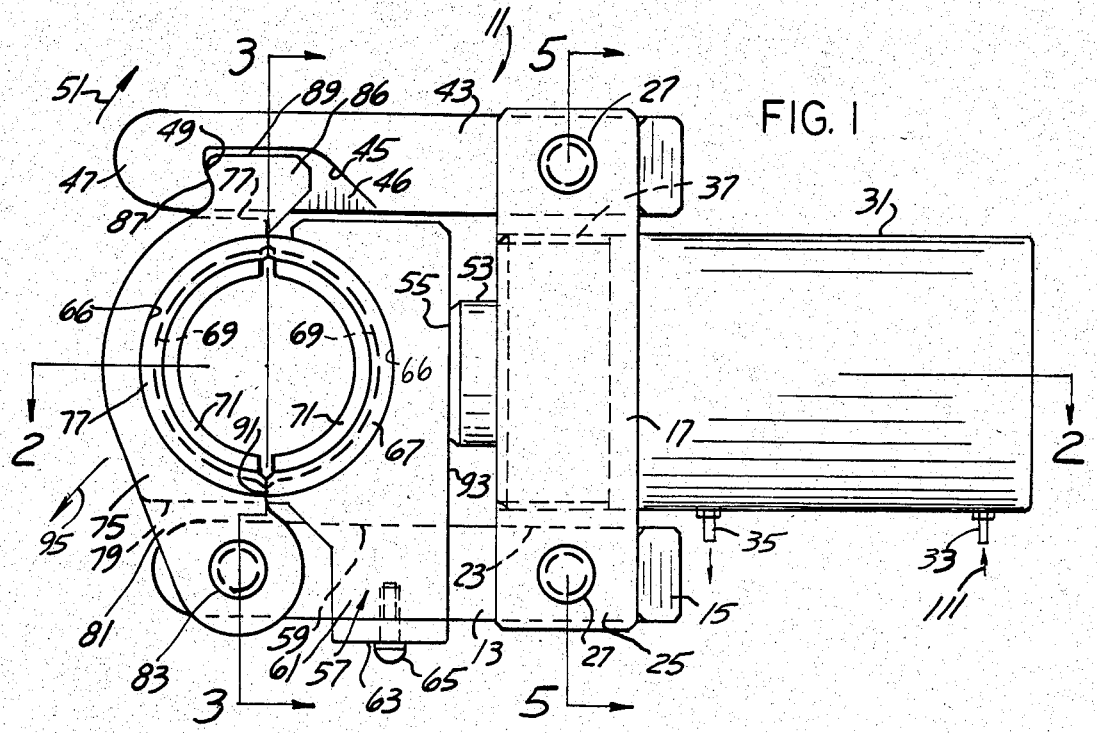
FIG. 1 is a side elevational view of the present shrink ring clamp assembly.

Referring to the drawings, the present shrink ring clamp assembly is generally indicated at 11 in FIG. 1 and includes an elongated base 13 adapted for connection to a suitable support, not shown, having upon one end the transverse stop block 15.

Figure 3:
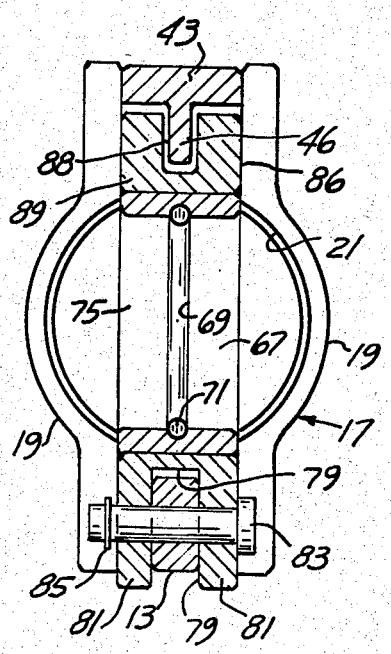
FIG. 3 is a vertical section taken in the direction of arrows 3—3 of FIG. 1.
Figure 5:
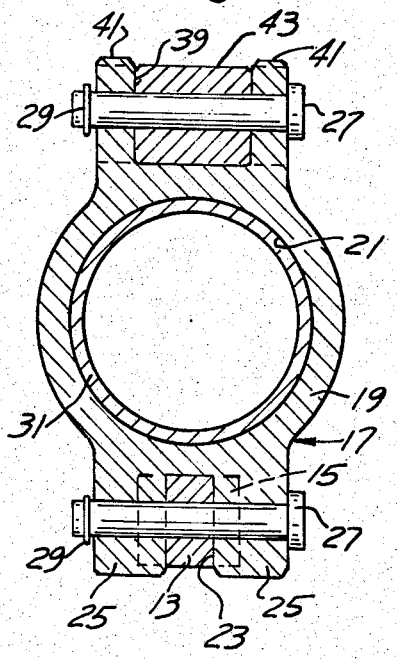
FIG. 5 is a vertical section taken in the direction of arrows 5—5 of FIG. 1.

Upright cylinder support 17, outwardly bowed at 19, FIG. 3 has a transverse threaded bore 21 intermediate its ends and at its lower end has an undercut slot 23, FIG. 5 defining the bifurcations 25 which are positioned over the base 13 and secured thereto by the transverse pivot pin 27 and clamp ring 29.

Power cylinder 31, in the illustrative embodiment a pneumatic cylinder having pressure fittings 33 and 35 adapted for connection to a source of air pressure as at 111, FIG. 1, is at one end exteriorly threaded at 37 for assembly and threaded engagement within bore 21 of cylinder support 17.

Latch bar 43 intermediate its ends is cut away on opposite sides at 45 defining the depending web 46. The outer end of latch bar 43 terminates in the latch 47 having upon its interior and within the cut away portion 45, the inclined retainer surface 49. The latch bar 43 is adapted to swing upwardly in a pivot path 51, FIG. 1, when the piston rod 53 is retracted from the advanced position shown. Piston rod 53, connected to a suitable piston within cylinder 31, projects outwardly of said cylinder and cylinder support 17 and has a transverse end face 55. Upright first die holder 57 has an undercut slot 59 defining bifurcations 61 which extend around opposite sides of base bar 13.

Bottom cover plate 63 spans bifurcations 61 and is secured thereto by fasteners 65. Plate 63 retains the first die holder 57 for slidable adjustment upon base 13. Die holder 57 has within its outer surface an upright semi-circular recess 66 within which is positioned a corresponding semi-circular first jaw insert 67.

Within said insert there is formed a semi-circular recess 69 shown in dash lines in FIG. 1, which is semi-circular in cross-section and within which is secured the upright shrink ring die segment 71 portending an arc of 180°. The die segment 71 may be of two aligned 90 degree sections.

In the illustrative embodiment, the corresponding die segment 71 is suitably secured within the semi-circular recess 69 of the first die insert 67 as by welding or brazing or using a suitable adhesive. Said insert is removable to permit substitution of a different insert with a die segment of different internal diameter.

A second or pivot die holder 75 is opposed to the first die holder 57 and has a corresponding opposed semi-circular recess 66 formed therein. Semi-circular die insert 77 is nested and retained within recess 66 within die holder 75 and upon its interior surface has a corresponding opposed semi-circular channel or recess 69 of semi-circular cross-section.

One end of the die holder 75 has an undercut slot 79 therein, FIG. 3, providing the opposed bifurcations 81 to receive end portions of the base 13 and are pivotally connected thereto by pivot pin 83 and clamp ring 85.

Latch member 86 upon one end of die support 75 has a forwardly and upwardly inclined anchor surface 87 adapted for cooperative registry with the corresponding inclined anchor surface 49 upon latch 47. The rib 46 depending from an intermediate portion of latch bar 43 cooperatively nests within the corresponding slot 88 formed within latch member 86, FIG. 3. Slot 88 defines within the latch member 86 the bifurcations 89. Adjacent one end of the first die holder 57 and extending forwardly thereof is the fulcrum 91 adapted for cooperative engaging registry with the second die support 75, FIG. 1.

Upon application of pressurized air from the source 111 to the fitting 35 of power cylinder 31, piston rod 53 is retracted from its engagement with abutment surface 93 of first die holder 57.

With the piston rod 53 retracted and relieving reactive pressure of the cylinder assembly and the latch bar 43 with respect to the pivotal die support 75, latch bar 43 may be rotated upwardly in an arc 51, FIG. 1, and successively the pivotal die support 75 may be rotated in the arc 95.

It is this opening up of the latch bar 43 with respect to the pivotal die support 75 which permits assembly and dissassembly of the telescoped pipes 99, 101, normally extending transversely between the semi-circular coplanar die segments 71.

Figure 2:
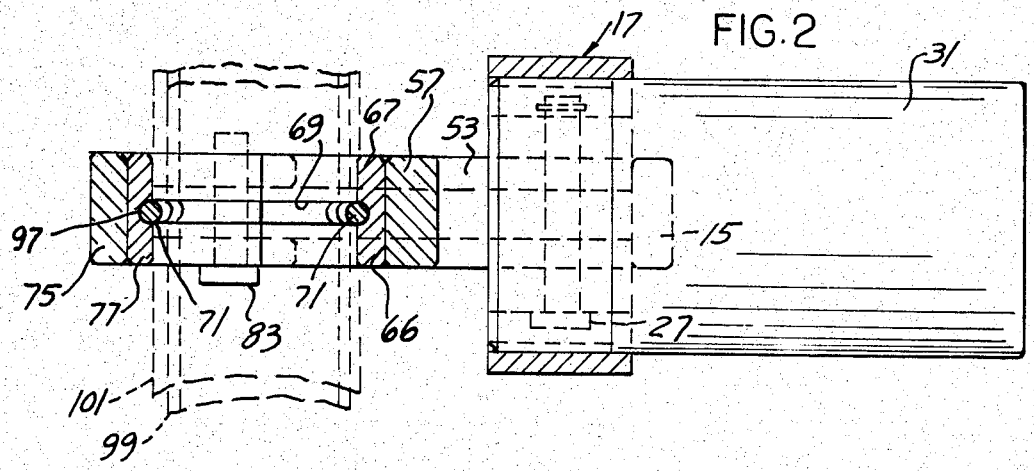
FIG. 2 is a plan section thereof taken in the direction of arrows 2—2 of FIG. 1.
Figure 6:
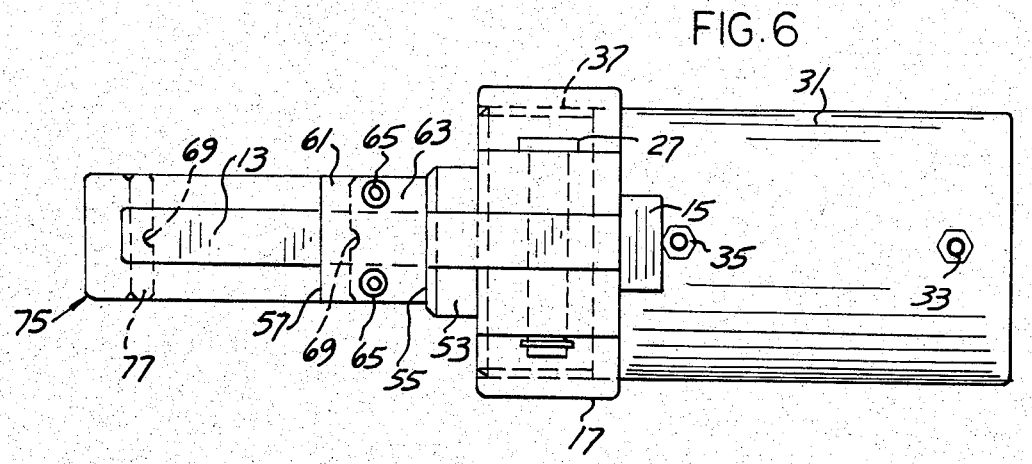
FIG. 6 is a bottom plan view thereof.
Figure 4:
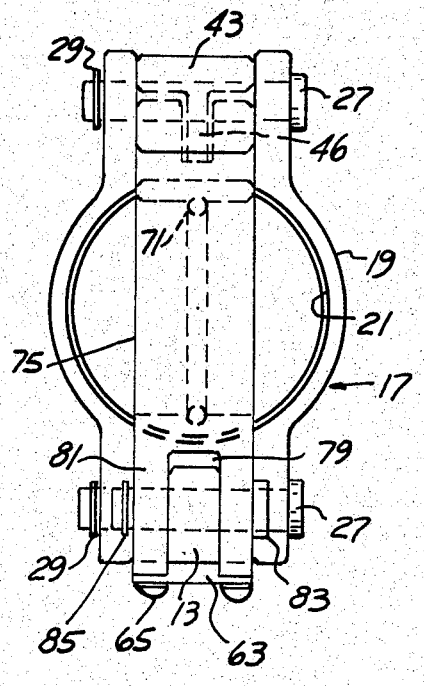
FIG. 4 is an end elevational view of FIG. 1.

The corresponding shrink ring die segments 71 are suitably anchored within semi-circular recesses 69 within the die inserts 67 and 77 by brazing at 97, FIG. 2, or welding or the like. Under some conditions, the die segments 71 could be adhesively secured within the corresponding recesses 69 so that they could be replaced with die segments of different internal diameter for different diameters of pipes to be secured together. Normally the inserts 67, 77 are replaceable.

Figure 8:
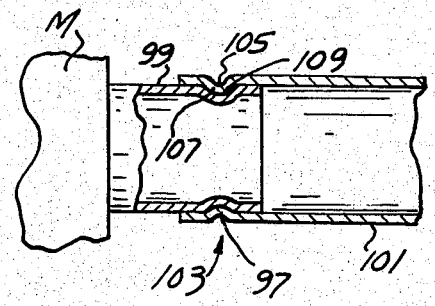
FIG. 8 is a fragmentary longitudinal section illustrating the securing of the pair of telescoped pipes utilizing the present shrink ring clamp assembly and the method.

In FIG. 8, a muffler M is fragmentarily shown having an outlet pipe 99, sometimes referred to as a first pipe. Telescoped thereover is the second pipe 101 which may be a tail pipe or other pipe of an exhaust system providing an overlap 103 therebetween.

In the operation of the present shrink ring clamp assembly with the piston rod 53 retacted from the position shown in FIG. 1, the die holder 75 as well as the latch bar 43 may be rotated to open positions as designated by the arrows 95 and 51. The pair of telescoped pipes 99 and 101, which may be pipes of an exhaust system, though not limited thereto, extended transversely between the respective die holders 57, 75 and die holder 75 is pivotally returned to the position shown in FIG. 1. The latch bar 43 is rotated downwardly to interlock with latch element 86.

When pressure is applied to fitting 33 of cylinder 31, piston rod 53 is advanced forcefully so that its end face 55 is in operative engagement with the abutment surface 93 of die holder 57.

Since the die holder 57 is essentially stationary once set in its proper position upon base 13, reaction pressure from engagement of the piston rod with die holder 57 transmits a reaction pressure to the cylinder 31, to the cylinder support 17 and to latch bar 43 operatively drawing the second die holder 75 into compressive operative engagement with respect to the assembled pipes 99 and 101. In this situation, the opposed shrink ring die segments 71 which are coplanar, form within the pipes as assembled concentric annular recesses 105 and 109 and the corresponding annular bead 107. Said bead 107 on the outer pipe 101 cooperatively nests and seals within the annular recess 109 formed within inner pipe 99. This provides a mechanical interlock and seal between the respective pipes throughout 360°.

After the telescoped pipes are removed from the present shrink ring clamp assembly, all that remains is the assembly of the pair of pipes 99, 101 as telescoped with an annular mechanical interlock and seal therebetween, FIG. 8.

The present invention contemplates the method furthermore of securing together and sealing a pair of telescoped pipes such as the pipes 99 and 101, which may be adjacent overlapped pipes in a vehicle exhaust system. As a primary step, a pair of opposed semicircular shrink ring die segments 71 are forcefully drawn towards each other in a unit plane so as to form within the assembled concentric annular channels 105 and 109 and the corresponding bead 107 which nests within channel 109.

The present method provides a means by which the pair of telescoped pipes, FIG. 8 are secured to each other and remain secured in a substantially permanent manner without the use of any remaining clamp or clamp ring. The final product, as a result of the present apparatus and the method defined herein is illustrated in FIG. 8.

The respective die holders 57 and 75 are contructed of a high tensile alloy, referred to for illustration as "D-2".

The corresponding jaws, inserts 67, 77 with their semi-circular opposed coplanar recesses 69 therein are adapted to receive the corresponding shrink ring segments 71. Inserts 67, 69 may be replaced with ring segments 71 of different sizes for accomodating different size pipes to be secured together.

Figure 7:
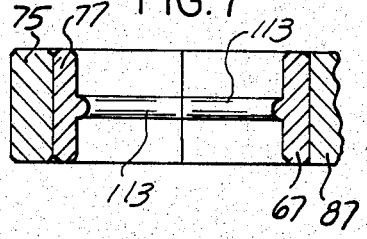
FIG. 7 is a fragmentary section corresponding to FIG. 2 illustrating a different form of semi-circular die segments.

In FIG. 7 the opposed pair of inserts 67, 77 may each have semi-circular integral beads 113 replacing the die segments 71 of FIG. 2.

Having described my invention reference should now be had to the following claims:

I claim:

1. The method of securing together and sealing a pair of telescoped pipes for a vehicle exhaust system comprising:

assembling face to face a pair of opposed die supports having opposed internal semi-circular recesses of semi-circular cross-section;

forming a pair of semi-circular shrink ring die inserts of circular cross-section; said circular cross-section being constant throughout the dies arc;

assembling and securing said die inserts within the recesses of said die supports respectively so that a portion of each die insert throughout its arc protrudes above each recess;

said die inserts each portending an arc less than 180°;

assembling a pair of telescoped engaging pipes for a vehicle exhaust system transversely through and between the pair of semi-circular shrink ring die inserts;

and forcefully drawing the die supports and die inserts towards each other in a unit plane compressively engaging said pipes throughout 360° and forming concentric outer annular channels in said pipes and a corresponding annular bead in the outer pipe nested and retained within the channel on the inner pipe by said protruding die insert portions thereby providing an annular mechanical interlock and seal between said pipes throughout 360° as the sole means for permanently securing said pipes together and against relative lengthwise movement; and removing said die supports and die inserts from said joined pipes.

* * * * *